United States Patent [19]

Shiozawa

[11] Patent Number: 4,787,869

[45] Date of Patent: Nov. 29, 1988

[54] WATER LOCK DEVICE FOR MARINE PROPULSION

[75] Inventor: Shigeki Shiozawa, Hamamatsu, Japan

[73] Assignee: Sanshin Kogyo Kabushiki Kaisha, Hamamatsu, Japan

[21] Appl. No.: 119,053

[22] Filed: Nov. 10, 1987

[30] Foreign Application Priority Data

Nov. 14, 1986 [JP] Japan ..... 61-271194

[51] Int. Cl.[4] ..... F01N 3/00

[52] U.S. Cl. ..... 440/89; 137/527.8; 251/338

[58] Field of Search ..... 440/88, 89, 112; 181/226-228, 237; 137/527, 527.8; 251/305-308

[56] References Cited

U.S. PATENT DOCUMENTS 4,178,873 12/1979 Bankstahl ..... 440/89

4,498,876 2/1985 Zemlicka ..... 440/89

4,609,068 9/1986 Backlund ..... 181/237

*Primary Examiner*—Joseph F. Peters, Jr.

*Assistant Examiner*—Jesûs D. Sotelo

*Attorney, Agent, or Firm*—Ernest A. Beutler

[57] ABSTRACT

Several embodiments of marine propulsion exhaust systems including water lock devices for precluding the entry of water into the engine through its exhaust ports. In each embodiment, the water lock device comprises a control valve that has flow openings for permitting the flow of exhaust gases through the control valve even when the control valve is in its closed position. The flow openings are, however, positioned so as to prevent the flow of water into the engine under these conditions. The openings also create different effective areas so that exhaust pressure tends to open the valve and water pressure tends to close the valve.

15 Claims, 5 Drawing Sheets

WATER LOCK DEVICE FOR MARINE PROPULSION

BACKGROUND OF THE INVENTION

This invention relates to a water lock device for marine propulsion units and more particularly to an improved exhaust control valve for a marine propulsion unit for preventing the flow of water into the engine through the exhaust system.

As is well known in marine propulsion, the exhaust gases from the powering engine are frequently discharged to the atmosphere through the body of water in which the associated watercraft is operated. This means that the exhaust discharge from the exhaust system is, at least at times, submerged. Because of this, there is always a danger that water can enter the engine through the exhaust system. Of course, this can cause difficulties. There have been proposed, therefore, control valves that are provided in the exhaust system and which will close under conditions when the engine is not running so as to prevent water from entering the engine through its exhaust system. The valves that have been proposed to control the exhaust gases and prevent such reverse water flow have, however, given rise to certain problems. Specifically, the valves of the type previously used for this purpose have a tendency to maintain in a closed position even if the engine is still running so long as some water is backed up into the exhaust system as can occur during reverse operation or upon sudden deceleration. As a result, the failure of the exhaust gases to be able to escape can cause stalling of the engine and this is not at all desirable.

It is, therefore, a principal object of this invention to provide a water lock device for a marine propulsion unit wherein the flow of exhaust gases will not be impeded even though water may enter the exhaust system.

It is a further object of this invention to provide an improved water control valve that will preclude the flow of water into the engine even though the exhaust gases are permitted to flow from the engine through the exhaust system.

In accordance with valves that have been previously proposed to control the flow of exhaust gases and inhibit the flow of water into the engine through the exhaust system, the valves have, for the most part, been gravity operated and have been weighted to a closed position. As a result, the engine must achieve a certain back pressure in order for the control valve to be opened. This aggravates the problems as aforedescribed.

It is, therefore, a further object of this invention to provide an improved control valve for the exhaust gases of a marine propulsion device which will operate more efficiently and which will achieve its desired results.

It is a further object of this invention to provide an improved control valve for a marine propulsion unit exhaust system that will permit the free flow of exhaust gases while preventing the flow of any water to the engine through the exhaust system.

SUMMARY OF THE INVENTION

A first feature of this invention is adapted to be embodied in an exhaust system for a marine propulsion unit having an engine with an exhaust system that includes a discharge designed at times to be submerged. An exhaust control valve is moveable between an opened position for unrestricted flow through the exhaust system and a closed position wherein water is restricted from entering the engine through the exhaust system. In accordance with this feature of the invention, means permit exhaust gases to flow through the exhaust system even when the exhaust control valve is in its closed position.

Another feature of the invention is also adapted to be embodied in an exhaust system for marine propulsion unit having an engine with an exhaust system and a control valve as described in the preceding paragraph. In accordance with this feature of the invention, the control valve is a butterfly type valve and is unbalanced so that the exhaust gas pressures and water pressures tend to cause the valve to open and close, respectively.

BRIEF DESCRIPTION OF THE DRAWINGS

FIG. 3 shows the position of the valve when the engine is not running.

FIG. 4 shows the position of the control valve when the engine is running.

FIG. 5 shows the position of the control valve when water tends to back up into the exhaust system.

FIG. 10 shows the condition when the engine is not running.

FIG. 11 shows the condition when the engine is running.

FIG. 12 shows the condition when water attempts to back up into the system.

DETAILED DESCRIPTION OF THE PREFERRED EMBODIMENTS

Figure 1:
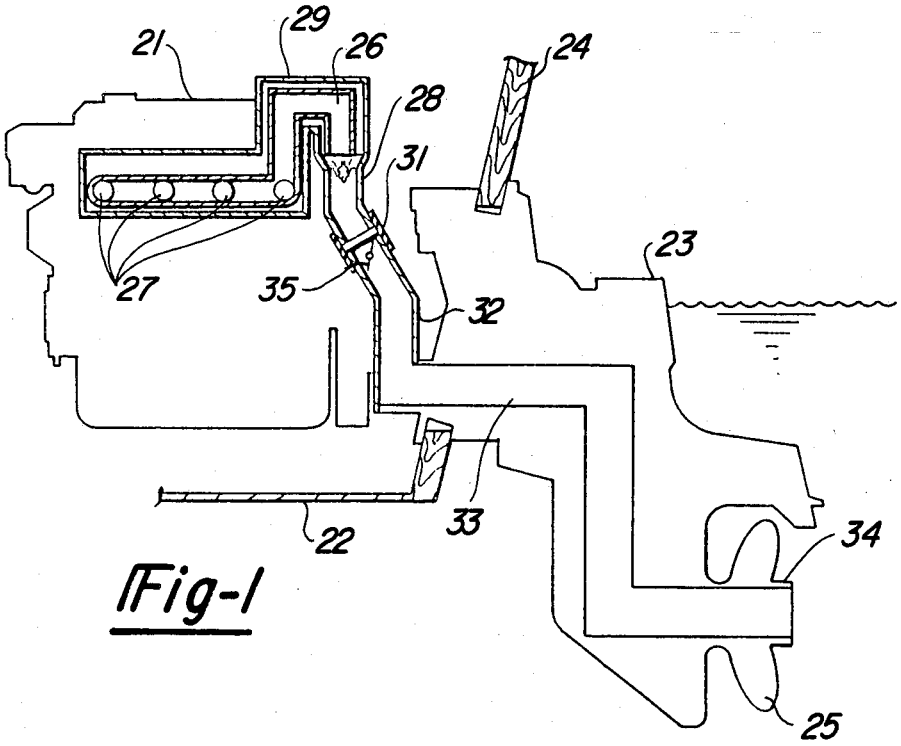
FIG. 1 is a side elevational view, with portions shown in cross-section and other portions shown schematically of a marine propulsion unit constructed in accordance with a first embodiment of the invention.
Figure 2:
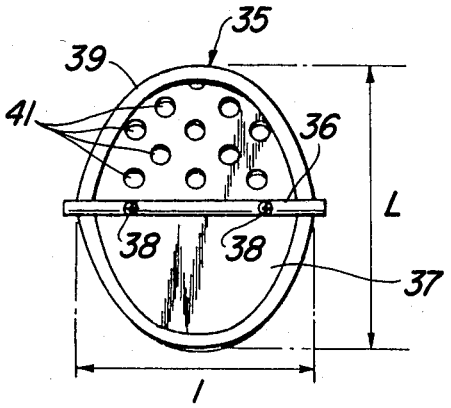
FIG. 2 is an enlarged end elevational view showing the configuration of the exhaust control valve.
Figure 3:
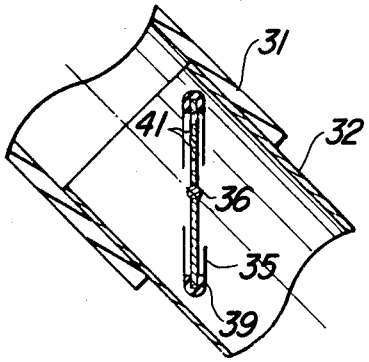
FIG. 3 through 5 are cross-sectional views showing the control valve of this embodiment in various positions.

Referred first to FIG. 1, a typical environment in which the invention may be employed is illustrated.

The illustrated embodiment depicts a marine inboard/-outboard drive including an internal combustion engine 21 that is mounted within a hull 22 of a watercraft and which drives an outboard drive unit 23 in a known manner. The outboard drive unit 23 is mounted upon a transom 24 of the hull 22 for steering, tilting and trim movement in a known manner. A propeller 25 is driven by the engine 21 for propelling the watercraft. The construction as thus far described may be considered to be conventional and, for that reason, details of the construction of the drive, steering, tilt and trim mechanisms are not believed to be necessary to understand the invention.

The engine 21, which may be of any known type, is provided with an exhaust system that includes an exhaust manifold 26 that communicates with exhaust ports 27 of the engine 21 and conveys the exhaust gases to an exhaust pipe 28. A trap section is provided in the manifold 26 for assisting and insuring that water will not flow into the engine through the exhaust ports 27 from the exhaust system.

A water manifold 29 encircles the exhaust manifold 26 and receives coolant from the engine in a known manner. The water manifold 29 has a discharge end which discharges the coolant into the exhaust pipe 28 around the discharge of the exhaust manifold 26. As a result, cooling water and exhaust gases are delivered to the exhaust pipe 28.

The exhaust pipe 28 has an elastic expansion pipe 31 connected to its discharge end. The exhaust extension pipe 31 couples the exhaust pipe 28 to a further exhaust pipe 32 that forms a portion of the outboard drive unit 23. To this end, there is provided an exhaust passage 33 that extends through the outboard drive unit 23 and which terminates in a through the propeller hub exhaust gas discharge 34 from which th exhaust gases are discharged. It should be noted that the discharge 34 is normally at least partially submerged during watercraft operation.

A control valve, indicated generally by the reference numeral 35 and shown in most detail in FIGS. 2 through 5 is provided for permitting the flow of exhaust gases through the exhaust system including the manifold 26, exhaust pipe 28, expansion pipe 31 and outboard drive exhaust pipe 32. However, the control valve 35 will prevent water from reentering the exhaust system.

Referring now to FIGS. 2 through 5, it will be noted that the control valve 35 is provided in the upper end of the exhaust pipe 32. The exhaust pipe 32 is inclined at an angle to both be horizontal and vertical in the area where the control valve 35 is positioned. This provides certain advantages, to be noted, in the operation of the control valve 35 and its functioning to permit the flow of exhaust gases in an unrestricted manner while, at the same time, insuring that water cannot enter the engine through the exhaust ports 27 from the exhaust system.

Figure 5:
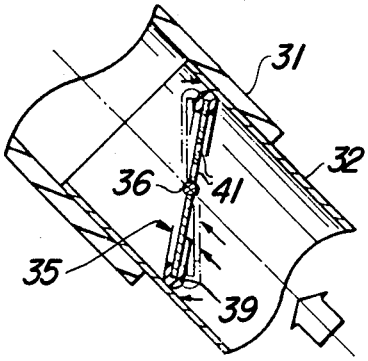

The control valve 35 is of the butterfly type and includes a valve shaft 36 that is supported within the exhaust pipe 32 for rotation about a horizontally extending axis. A valve plate, indicated by the reference numeral 37 is affixed to the valve shaft 36 by means of screws 38. It should be noted from FIG. 2 that the valve plate 37 has a generally oval configuration. That is, the dimension 1 in the horizontal axis is substantially less than the dimension L in the vertical direction. An elastic sealing material 39 is affixed to the periphery of the valve plate 37 and is adapted to sealingly engage the inner periphery of the exhaust pipe 32 when the valve 35 is in its fully closed position (FIG. 5).

Figure 4:
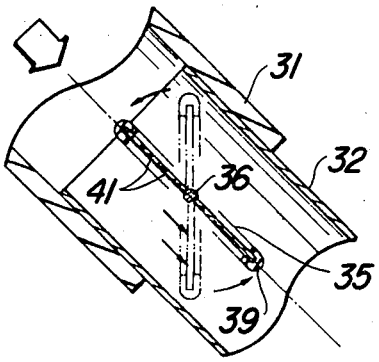

There are provided in the upper half of the valve plate 37 a plurality of flow openings 41. The flow openings 41, in this embodiment, comprise circular holes. As will be described, however, the other forms of flow passages may be formed in the upper or upstream half of the valve plate 37. The effect of the holes 41, in addition to providing flow openings, is that the upper or upstream side of the valve plate 37 has a lesser effective area than the lower or downstream side of the valve plate. As a result, the exhaust gas pressure on the valve 35 will cause it to become unbalanced and cause it to swing open from a normal partially closed position, wherein the valve plate 37 assumes a vertical orientation (FIG. 3) to a fully opened position as shown in FIG. 4. However, if water tends to reenter the exhaust system and flows against the lower side of the valve plate 37, the valve plate will swing under this pressure difference to a closed position as shown in FIG. 5 so as to prevent water from entering the engine through the exhaust ports 27. Under this condition, however the exhaust can still flow since any water in the exhaust pipe 32 will be at the lower side of the exhaust pipe where the flow openings 41 are not present. As a result, even when the valve plate 37 is fully closed exhaust gases may exit from the exhaust system and the engine will not be stalled due to excessive back pressure. Thus, even when the boat is operating in reverse and water tends to flow up into the exhaust system, the engine will continue to run and safety is assured.

Figure 6:
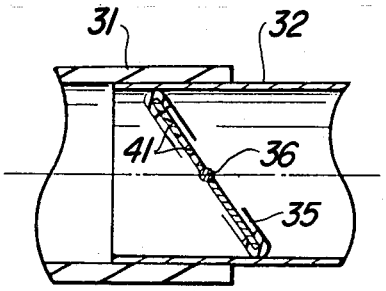
FIG. 6 is a cross-sectional view, in part similar to FIGS. 3 through 5, showing an exhaust control valve positioned in an exhaust system configured differently from the embodiment of FIG. 1.

Although the invention has particular utility in conjunction with arrangements wherein the control valve 35 is positioned in an inclined portion of th exhaust system, the device will also operate where the control valve 35 is oriented with the exhaust pipe 32 being positioned horizontally and FIG. 6 shows such an arrangement. In all other regards this embodiment is the same as the previously described embodiment and, for that reason, further discussion of this embodiment is believed to be unnecessary.

Figure 7:
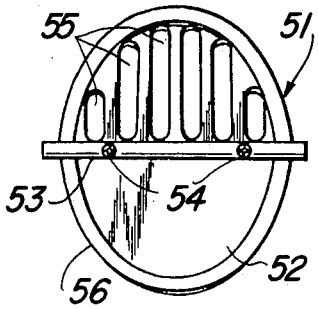
FIG. 7 is an end elevational view, in part similar to FIG. 2, showing another embodiment of exhaust control valve.

A control valve constructed in accordance with yet another embodiment of the invention is shown in FIG. 7 and is identified generally by the reference numeral 51. The control valve 51 may be operated in an orientation either as shown in FIG. 1 or as in FIG. 6. In this embodiment, a valve plate 52 is affixed to the control valve shaft 53 by means of screws 54. The valve plate 52 has a generally oval configuration and its lower half is imperforate. The upper half is, however, provided with a plurality of generally vertically oriented oval openings 55 so as to provide flow relief for exhaust gases. An elastic sealing material 56 encircles the periphery of the valve plate 52 for sealing purposes.

As with the previously described embodiment, the flow openings 55 will permit exhaust gases to flow even when the control valve 51 is in a fully closed position. However, since the exhaust gases are lighter than water and since the lower half of the valve plate 52 is imperforate, water cannot reenter the exhaust system through the openings 55.

Figure 8:
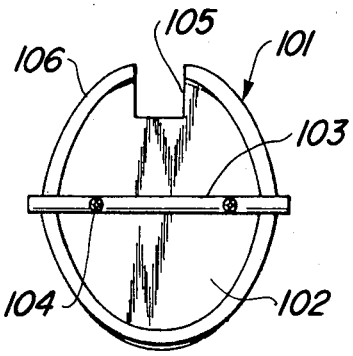
FIG. 8 is an end elevational view, in part similar to FIGS. 2 and 7, showing yet another embodiment of control valve.

Yet another embodiment of the invention is shown in FIG. 8 and the control valve therein is identified generally by the reference numeral 101. The control valve 101 is comprised of a valve plate 102 that is affixed to a control valve shaft 103 by means of screws 104. In this embodiment, the control valve plate 102 is provided with a peripheral notch 105 on its extreme upper portion. In the illustrated embodiment, the notch 105 has a rectangular configuration but it should be readily apparent that other configurations can be chosen.

An elastomer sealing material 106 is affixed to the periphery of the valve plate 102 except in the area of the flow relief notch 105. As should be readily apparent to those skilled in the art, the flow relief notch 105 will permit exhaust gases to flow through the exhaust system even when the control valve 101 is closed. However, due to its upstream location and upper extent, water cannot flow back into the exhaust system through the relief notch 105.

Figure 9:
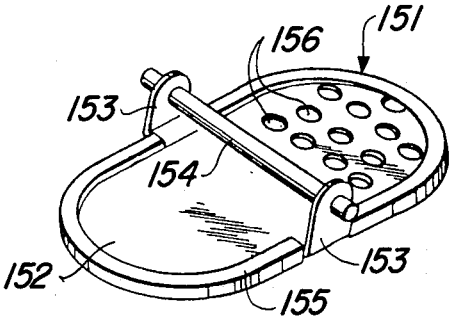
FIG. 9 is a perspective view of an exhaust control valve constructed in accordance with a still further embodiment of the invention.
Figure 10:
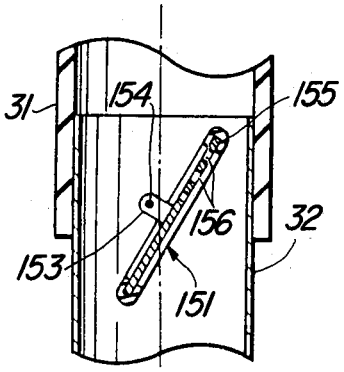
FIGS. 10 through 12 are cross-sectional views, in part similar to FIGS. 3 through 5, showing the exhaust control valve of FIG. 9 in various conditions.
Figure 11:
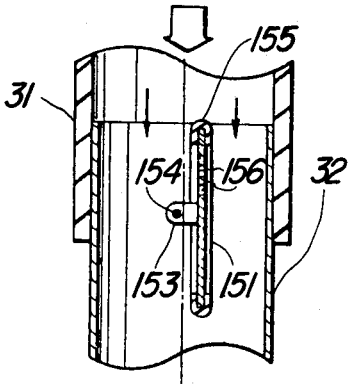
Figure 12:
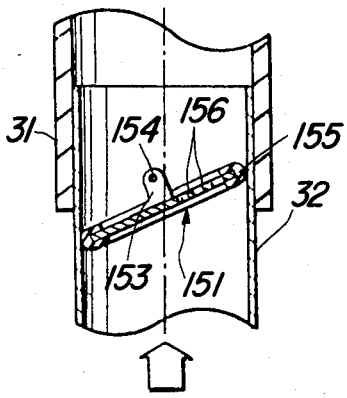

A control valve constructed in accordance with yet another embodiment of the invention is identified generally by the reference numeral 151 and is shown in perspective in FIG. 9. The control valve 151 is particularly adapted for use in systems wherein the associated exhaust pipe 32 extends vertically as shown in FIGS. 10 through 12. In this embodiment, a control valve 151 is comprised of a valve plate 152 that has a generally oval configuration and which is provided with a pair of flanges or tangs 153 at its side periphery. The flanges 153 are provided with openings so as to rotatably journal the valve plate 152 on a control valve shaft 154. As with the previously described embodiments, an elastic sealing material 155 is affixed to the outer periphery of the valve plate 152 and flow relieving openings 156 are formed in the upper or upstream portion of the valve plate 152. The lower portion of the valve plate 152 is imperforate.

As may be best seen in FIG. 10, because the control valve shaft 155 is offset from the valve plate by the flanges 153, the valve plate will, by gravity, swing to a partially closed position because the lower half of the valve plate is heavier than the upper half. The flow relief openings 156 provide this weight difference as does the offset, as aforementioned. When the engine is running and there is pressure of exhaust gases, the exhaust gases will cause the valve 151 to move to a fully opened position (FIG. 11) since the downstream side of the valve plate 152 has a greater effective area the than the upstream side. In a like manner, if water tends to flow upwardly through the exhaust pipe 31 the valve plate 152 will be swung to a closed position (FIG. 12). In this position, however, exhaust gases may still flow through the flow relief openings 156. Because water is heavier, it will however be precluded from flowing through these openings.

Figure 13:
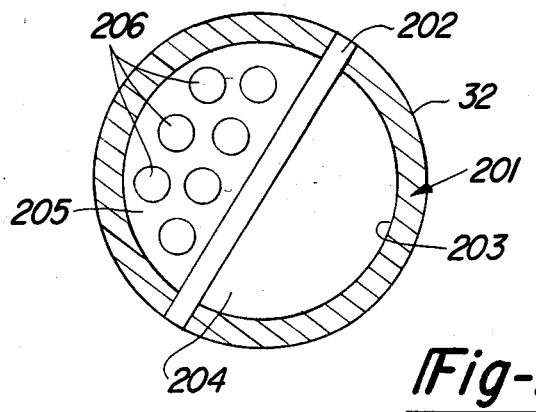
FIG. 13 is an end elevational view, in part similar to FIGS. 2, 7 and 8, showing a valve constructed in accordance with yet another embodiment of the invention.

In the embodiments of the invention as thus far described, the axis of the control valve shaft has been positioned in a diametral plane that lies perpendicular to the exhaust flow passage of the exhaust pipe. However, it is also possible to employ an arrangement wherein the shaft of the control valve is disposed at an angle to the exhaust pipe and does not lie on a diameter of it. Such an embodiment is shown in FIG. 13, wherein a control valve constructed in accordance with this embodiment is identified generally by the reference numeral 201. The control valve 201 includes a control valve shaft 202 that is disposed at an angle to the diameter of a passage 203 of the exhaust pipe 32. A valve plate 204 of appropriate configuration to close the opening 203 when the valve 201 is in its closed position is affixed suitably to the valve shaft 202. The valve plate 204 is divided into an upstream area 205 in which flow relief openings, in the form of circular holes 206 are formed. A downstream portion of the valve plate 204 is imperforate and, like the previously described embodiments, the pressure of exhaust gases will tend to open the control valve 201 while the pressure of water in the exhaust pipe 32 will tend to close the valve 201. Like the previously described embodiments, the periphery of the valve plate may have affixed to it an elastomeric sealing material (not shown).

Figure 14:
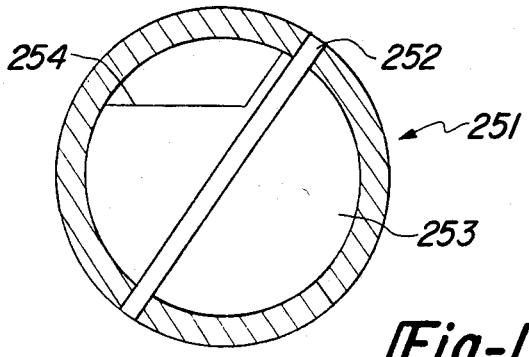
FIG. 14 is an end elevational view, in part similar to FIGS. 2, 7, 8 and 13, showing yet another embodiment of the invention.

Yet another embodiment of such an angularly disposed control valve is shown in FIG. 14 and is identified generally by the reference numeral 251. The control valve 251 includes a non-diametrically positioned valve shaft 252 to which a valve plate 253 is affixed. The valve plate 253 is formed with a lower downstream imperforate portion and an upper portion in which a flow recess 254 is formed. The recess 254 is formed at the upper side of the valve assembly 251 and may comprise a generally pie shaped cut-out in the valve plate 253.

Figure 15:
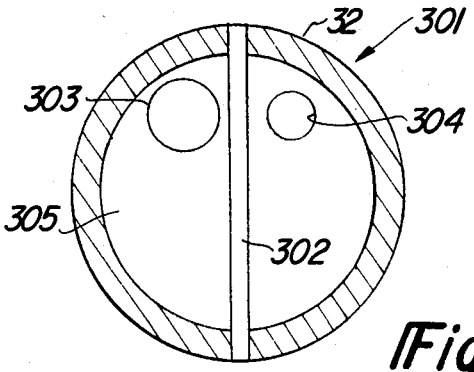
FIG. 15 is an end elevational view, in part similar to FIGS. 2, 7, 8, 13 and 14, showing a still further embodiment of the invention.

FIG. 15 shows yet another embodiment of the invention wherein the control valve is identified generally by the reference numeral 301. In this embodiment, the control valve 301 includes a vertically extending valve shaft 302 that is supported on a diameter of the exhaust pipe 32 and which extends generally vertically. A valve plate 305 is provided with a first opening 303 of a larger effective cross-sectional area and a smaller opening 304. Because of the difference in the size of the openings 303 and 304, the left hand side of the valve plate as seen in FIG. 15 will have a lesser effective area and pressure differences will cause the valve to open and close because of these pressure differences. However, since the openings 303 and 304 are positioned at the vertically upper periphery of the valve plate 305 the gases can flow through the control valve 301 even when the valve is in its closed position.

From the foregoing description it should be readily apparent that a number of embodiments of the invention have been illustrated and described each of which operates to insure that exhaust gases are permitted to flow through the exhaust system even if water is present in the exhaust system and tends to close the control valve. However, the closure of the control valve will insure that the water cannot enter the engine through its exhaust ports.

Although a number of embodiments of the invention have been illustrated and described, various other changes and modifications may be made without departing from the spirit and scope of the invention as defined by the appended claims.

I claim:

1. In an exhaust system for a marine propulsion unit having an engine with an exhaust system including a discharge designed at times to be submerged, an exhaust control valve moveable between an opened position for unrestricted flow through said exhaust system and a closed position wherein water is restricted from entering the engine through the exhaust system, the improvement comprising means for permitting exhaust gases to flow through said exhaust system when said exhaust control valve is in its closed position.

2. In an exhaust system as set forth in claim 1 wherein the means for permitting exhaust gases to flow comprises a flow relief passage formed in the body of the valve.

3. In an exhaust system as set forth in claim 2 wherein the flow relief opening comprises a plurality of holes.

4. In an exhaust system as set forth in claim 2 wherein the flow relief opening comprises a relief in the periphery of the valve.

5. In an exhaust system as set forth in claim 1 wherein the exhaust control valve comprises a butterfly valve having a valve plate.

6. In an exhaust system as set forth in claim 5 wherein the valve plate has an effectively greater downstream area than the upstream area so that the exhaust gas pressure tends to open the control valve and the water pressure tends to close the control valve.

7. In an exhaust system as set forth in claim 6 wherein the flow relief opening comprises a plurality of holes in the valve plate.

8. In a exhaust system as set forth in claim 6 wherein the flow relief opening comprises a relief in the periphery of the valve plate.

9. In an exhaust system as set forth in claim 1 wherein the means for permitting exhaust gas flow is formed at the upper vertical area of the control valve for precluding water flow therethrough.

10. In an exhaust system as set forth in claim 9 whrein the exhaust control valve comprises a butterfly valve having a valve plate.

11. In an exhaust system as set forth in claim 10 wherein the flow relief opening comprises a plurality of holes in the valve plate.

12. In an exhaust system as set forth in claim 10 wherein the flow relief opening comprises a relief in the periphery of the valve plate.

13. In an exhaust system for a marine propulsion unit having an engine with an exhaust system including a discharge designed at times to be submerged, an exhaust control valve moveable between an opened position for unrestricted flow through said exhaust system and a closed position wherein water is restricted from entering the engine through the exhaust system, the improvement comprising said exhaust control valve comprising a butterfly type valve having unequal flow areas provided by means of opening means in said valve whereby exhaust pressure acting upon said control valve effect pivotal movement of said control valve into an opened position and water pressure on said control valve tends to effect pivotal movement of said control valve to a closed position.

14. In an exhaust system as set forth in claim 13 wherein the opening means comprises a plurality of holes.

15. In an exhaust system as set forth in claim 13 wherein the opening means comprises a relief in the periphery of the control valve.

* * * * *